US007877035B2

(12) United States Patent
Inukai

(10) Patent No.: US 7,877,035 B2
(45) Date of Patent: Jan. 25, 2011

(54) ELECTRONIC DEVICE AND IMAGE FORMING APPARATUS

(75) Inventor: Katsumi Inukai, Iwakura (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 838 days.

(21) Appl. No.: 11/644,936

(22) Filed: Dec. 26, 2006

(65) Prior Publication Data

US 2007/0160379 A1 Jul. 12, 2007

(30) Foreign Application Priority Data

Dec. 26, 2005 (JP) ..... 2005-373468

(51) Int. Cl.
*G03G 15/00* (2006.01)

(52) U.S. Cl. ..... 399/88

(58) Field of Classification Search ..... 399/21, 399/37, 88, 128, 129, 182, 186; 361/679.21
See application file for complete search history.

(56) References Cited

U.S. PATENT DOCUMENTS

| | | | | |
|---|---|---|---|---|
| 4,272,183 | A * | 6/1981 | Maese et al. | 399/32 |
| 4,326,795 | A * | 4/1982 | Tajima et al. | 399/56 |
| 4,477,179 | A * | 10/1984 | Inuzuka et al. | 399/128 |
| 4,556,310 | A * | 12/1985 | Masuda | 399/77 |
| 4,772,914 | A * | 9/1988 | Kinoshita et al. | 399/88 |
| 5,945,789 | A * | 8/1999 | Chou | 315/324 |
| 6,661,072 | B1 * | 12/2003 | Cheng | 257/431 |
| 6,795,659 | B2 | 9/2004 | Uchida | |

FOREIGN PATENT DOCUMENTS

| | | | |
|---|---|---|---|
| JP | U-56-131473 | | 3/1980 |
| JP | 57038482 | A * | 3/1982 |
| JP | U-59-149357 | | 10/1984 |
| JP | A-61-75370 | | 4/1986 |
| JP | 02293887 | A * | 12/1990 |
| JP | 05035011 | A * | 2/1993 |
| JP | A 6-119563 | | 4/1994 |
| JP | A-7-199747 | | 8/1995 |
| JP | U-3033387 | | 10/1996 |
| JP | A 2003-076228 | | 3/2003 |
| JP | A 2003-137144 | | 5/2003 |
| JP | A 2004-333972 | | 11/2004 |
| JP | A 2005-109025 | | 4/2005 |

OTHER PUBLICATIONS

Nov. 2, 2010 Office Action issued in Japanese Patent Application No. 2005-373468 (with translation).

* cited by examiner

*Primary Examiner*—Robert Beatty
(74) *Attorney, Agent, or Firm*—Oliff & Berridge PLC

(57) ABSTRACT

An electronic device includes: a first electrical component; a second electrical component; a drive control unit that controls a driving of the second electrical component; and a power supply unit that supplies power to the first electrical component, wherein the drive control unit is connected via the first electrical component to the power supply unit to control the driving of the second electrical component by power supplied from the first electrical component.

3 Claims, 6 Drawing Sheets

ELECTRONIC DEVICE AND IMAGE FORMING APPARATUS

CROSS-REFERENCE TO THE RELATED APPLICATION(S)

This application is based upon and claims priority from prior Japanese Patent Application No. 2005-373468 filed on Dec. 26, 2005, the entire contents of which are incorporated herein by reference.

TECHNICAL FIELD

Aspects of the present invention relate to an electronic device having a plurality of electrical components and an image forming apparatus.

BACKGROUND

As electronic devices having a plurality of electrical components, a color thermal printer and a color laser printer, for example, are known. In a color thermal printer disclosed in JP-A-2005-109025, an image formed of three colors is thermally recorded by heating each thermal coloring layer of a color thermosensitive recording paper sheet with a thermal head. The sheet on which the image of each color is thermally recorded is sent to an optical fixing unit. The image is fixed by applying a fixing light over the entire recording face of the color thermosensitive recording paper sheet so that the thermal coloring on the upper layer may not be effected at the time of thermally recording on the lower layer for thermal coloring. The optical fixing unit includes groups each composed of a plurality of yellow light emitting elements and groups each composed of a plurality of magenta light emitting elements. One light emitting element for display is connected in series with light emitting elements in each group. A drive power source is connected in parallel with the groups to supply power and constitutes an LED drive circuit for driving the light emitting elements.

In the color thermal printer as disclosed in JP-A-2005-109025, for example, when any one of magenda light emitting elements in a group does not fail due to disconnection, a current flows through the light emitting element for display provided in the group to turn on the light emitting element for display. When one of magenta light emitting elements fails due to disconnection, no current flows through the light emitting element for display and thus the light emitting element for display is turned off. Therefore, the group including faulty light emitting elements can be specified and repaired by turning on or off the light emitting element for display.

SUMMARY

In the conventional color thermal printer, the light emitting element for display has to be provided for each group. Thus, the cost of parts increases. Also, the magenta and yellow light emitting elements are provided within a device main body, whereas the light emitting elements for display are provided to be exposed out of the device main body. Thus, a circuit for connecting the light emitting elements for display in series to the magenta and yellow light emitting elements respectively is complicated. Therefore, the manufacturing cost increases, Aspects of the present invention provide an electronic device, which has a simple electrical circuit structure and can be manufactured with low costs, and an image forming apparatus.

According to an aspect of the invention, there is provided an electronic device including: a first electrical component; a second electrical component; a drive control unit that controls the second electrical component; and a power supply unit that supplies power to the first electrical component, wherein the drive control unit is connected with the first electrical component, the drive control unit controlling the second electrical component by power supplied from the first electrical component.

According to another aspect of the invention, there is provided an image forming apparatus including: a photo-conductor; an eraser lamp that eliminates electric charge from the photo-conductor; an electrical component; a drive control unit that controls the electrical component; and a power supply unit that supplies power to the eraser lamp, wherein the drive control unit is connected with the eraser lamp, the drive control unit controlling the electrical component by power supplied from the eraser lamp.

DETAILED DESCRIPTION

Aspects of the present invention will be described below with reference to the drawings.

First Aspect

Figure 1:
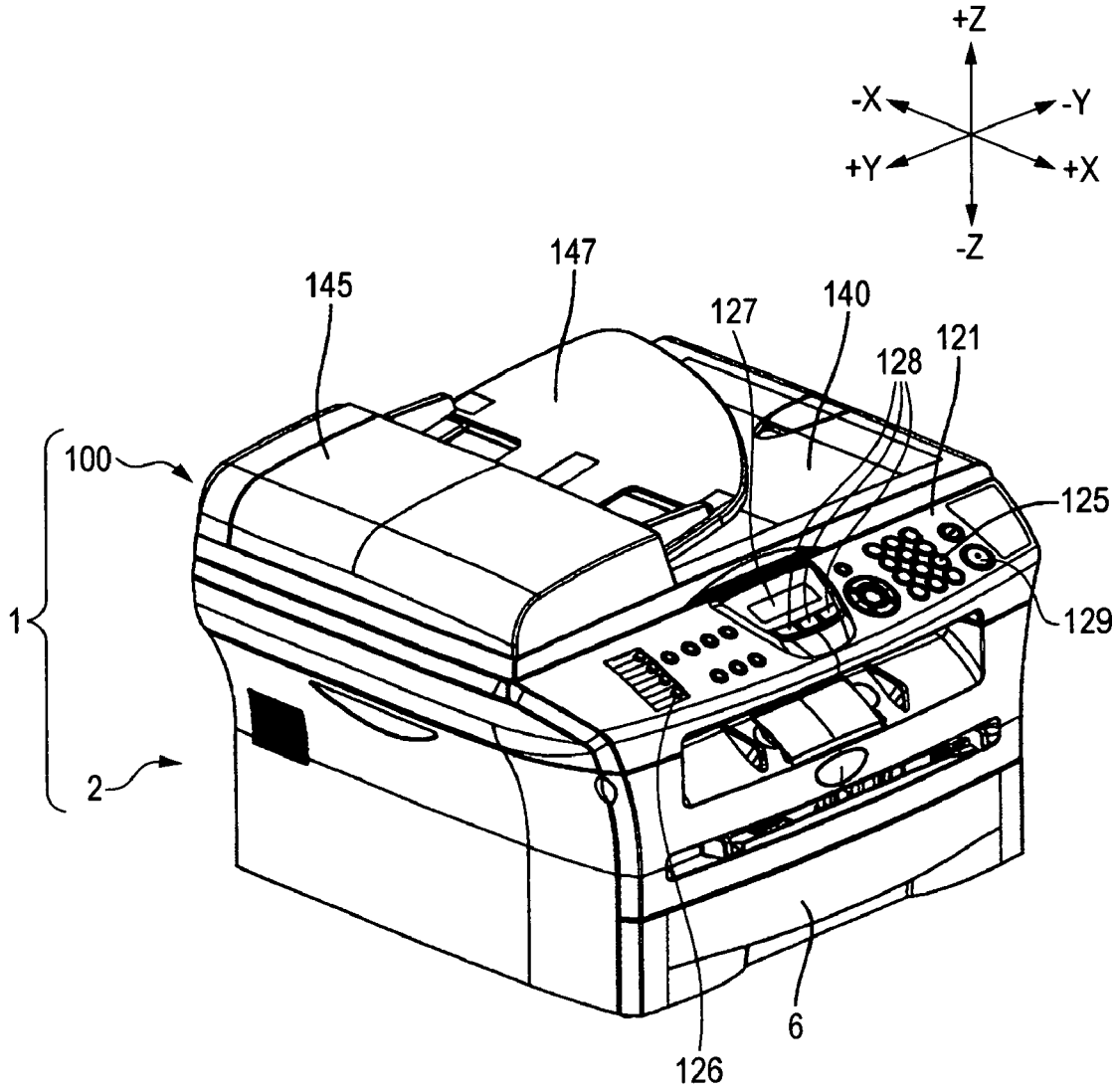
FIG. 1 is an external perspective view of a multi-function apparatus according to an aspect of the present invention.

FIG. 1 is an external perspective view of a multi-function apparatus 1.

In this aspect, the multi-function apparatus 1 having the multiple functions such as a printer function, a copy function, a scanner function and a facsimile function is employed as an electronic device and an image forming apparatus. The multi-function apparatus 1 includes an image forming unit 2 and an image reading unit 100. In the multi-function apparatus 1, a control circuit 50 is configured so that a user is informed of a failure of an eraser lamp (first electrical component) 32 disposed inside the image forming unit 2 while employing an existent electrical component (second electrical component).

Figure 2:
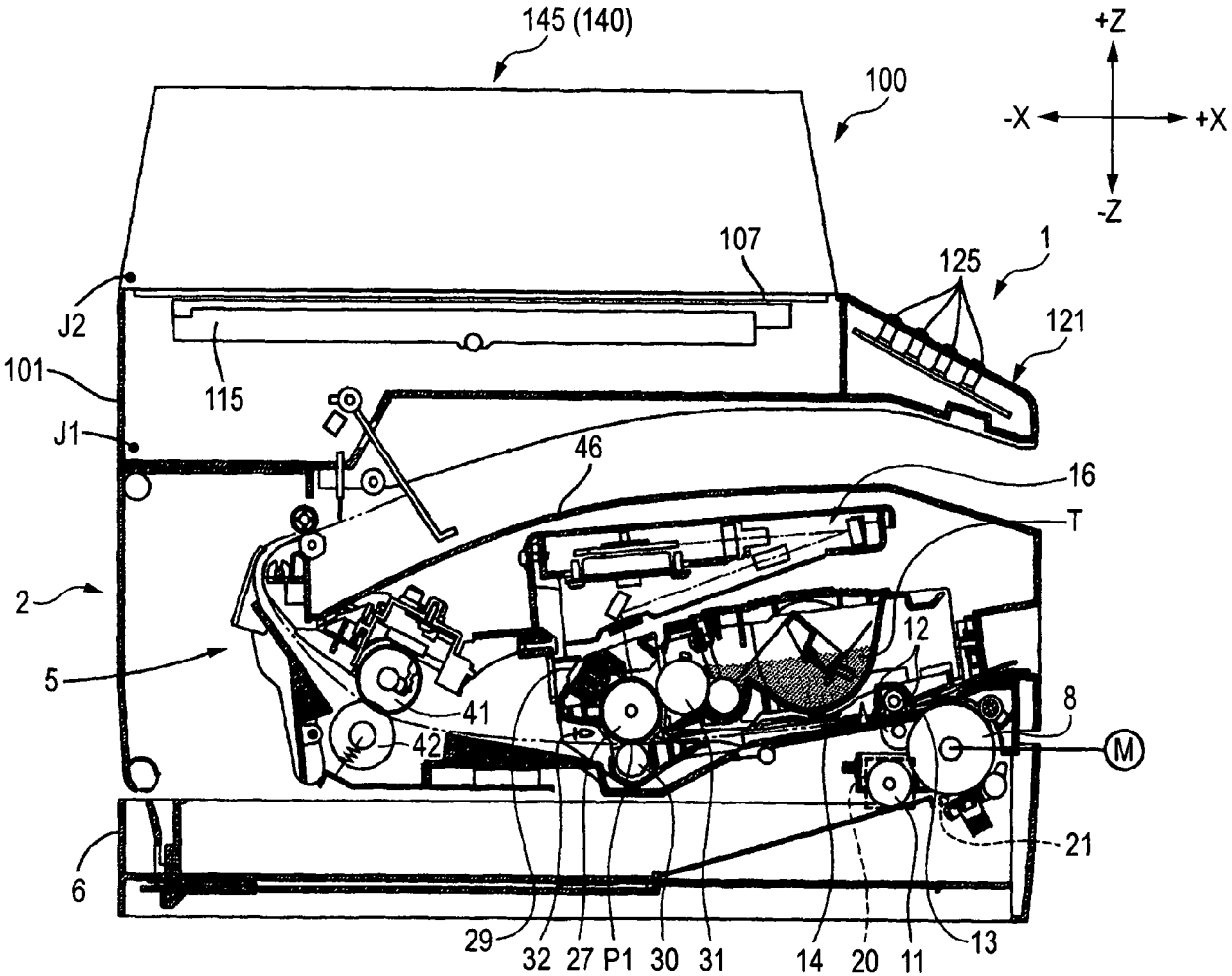
FIG. 2 is a cross-sectional view of the multi-function apparatus shown in FIG. 1.

FIG. 2 is a cross-sectional view of the multi-function apparatus 1 shown in FIG. 1.

The image forming unit 2 picks up a sheet from a sheet feed cassette 6, feeds it to an image forming part 5, forms an image on the sheet in the image forming part 5, and then discharges the sheet to a sheet discharge tray 46.

The image forming unit 2 conveys the sheet picked up from the sheet feed cassette 6 via a sheet feed roller 11, a separation roller 8, register rollers 12, a fixing roller 41, and a pressure roller 42 to the sheet discharge tray 46. Each of the rollers 8, 11, 12, 41 and 42 is held rotatably within the image forming unit 2. A drive torque of a motor M is transmitted via a power transmission gear train (not shown) to each roller shaft to rotate the roller. The driving of the motor M is controlled by a motor drive control circuit (not shown). In this aspect, the motor drive control circuit (not shown) drives the motor M, when a print command is inputted from a personal computer connected to the multi-function apparatus 1, and stops the driving of the motor M, when the printing ends.

A clutch solenoid is disposed on the power transmission gear train (not shown) whereby the power transmitted to each of the rollers 8, 11, 12, 41 and 42 is individually controlled by driving the clutch solenoid to connector disconnect the gears.

Specifically, an electromagnetic clutch solenoid 20 is provided for a power transmission gear train for transmitting power to the sheet feed roller 11, whereby the sheet in the sheet feed cassette 6 is picked up one by one by the sheet feed roller 11 and is delivered to a conveying path. when energized, the clutch solenoid 20 drives the power transmission gear train for the sheet feed roller 11 into a state capable of transmitting the power (hereinafter referred to as a "power transmittable state"). When de-energized, the clutch solenoid 20 drives the power transmission gear train for the sheet feed roller 11 into a state incapable of transmitting the power (hereinafter referred to as a "power untransmittable state"). Accordingly, the timing of picking up the sheet can be adjusted by controlling the driving of the clutch solenoid 20.

The sheet conveyed on the conveying path is detected by various kinds of sensors. For example, a sheet feed sensor 21 is disposed on the downstream side of the sheet feed roller 11 to detect the sheet picked up by the sheet feed roller 11. Also, a register sensor 13 is placed on the upstream side of the register rollers 12 to detect the sheet conveyed to the register rollers 12. The multi-function apparatus 1 controls the timing of driving an actuator 14 disposed on the downstream side of the register rollers 12, based on the detection result that the sheet feed sensor 21 and the register sensor 13 detect the sheet, adjusts the orientation of the sheet so that the front end of the sheet fed from the register rollers 12 to the image forming part 5 is set to orthogonal to the conveying path, and adjusts the interval of conveying the sheet to a predetermined interval.

The image forming part 5 has an image forming position P1 formed between a photosensitive drum 27 and a transfer roller 30. The photosensitive drum 27 is positively charged on the surface by a Scotron charger unit 29, subjected to a laser beam from a scanner part 16 to form an electrostatic latent image, and supplied with the toner T carried on a developing roller 31 to visualize the electrostatic latent image and form a reversal image. A transfer bias from the transfer roller 30 is applied to the photosensitive drum 27 to transfer the reversal image onto the sheet conveyed to the image forming position P1. And the image forming part 5 delivers the sheet, on which the image is transferred, toward a position between the fixing roller 41 and the pressure roller 42. The fixing roller 41 thermally fixes the image on the sheet. Then, the sheet is discharged onto the sheet discharge tray 46.

In the image forming part 5, a plurality of eraser lamps 32 are disposed in a row in a longitudinal direction of the photosensitive drum 27 on the upstream side of the Scotron charger unit 29 in a rotation direction of the photosensitive drum 27. The eraser lamps 32 apply a light for eliminating electric charge to the surface of the photosensitive drum 27. The photosensitive drum 27 has its surface voltage at 0V when the light from the eraser lamps 32 is applied to the surface, and is electrically cleaned. Therefore, the photosensitive drum 27 is uniformly charged without causing electrical unevenness, when charged by the Scotron charger unit 29, so that the toner T can be deposited on the electrostatic latent image only. Thereby, no excess lines are printed on the sheet and no print unevenness is caused whereby the print quality is assured.

On the image forming unit 2, an image reading unit 100 is held rotatably around a first hinge axis J1 and covers the sheet discharge tray 46.

In the image reading unit 100, an original cover 140 is held rotatably via a second hinge axis J2 on an upper casing 101. The original is laid on a platen glass 107 by opening the original cover 140, and an image of the original is read by an image sensor 115 accommodated within the upper casing 101. Also, the image reading unit 100 includes a well-known ADF mechanism 145 that takes the original one by one from an original supply tray 147 (see FIG. 1) and passes the original above the image sensor 115 being fixed to read the image from the original. An operation part 121 is provided on the front side of the image reading unit 100 (+X axis side in FIG. 1).

The operation part 121 includes various kinds of switch keys, including an input switch key 125 for inputting the number of sheets or the sheet size, a mode change-over switch key 128 for changing a copy mode, a facsimile mode and a print mode, and a start switch key 129 for instructing to start transmitting the facsimile data or copying, a display lamp 126 for displaying the running mode or the warning, and a liquid crystal panel 127, shown in FIG. 1.

Figure 3:
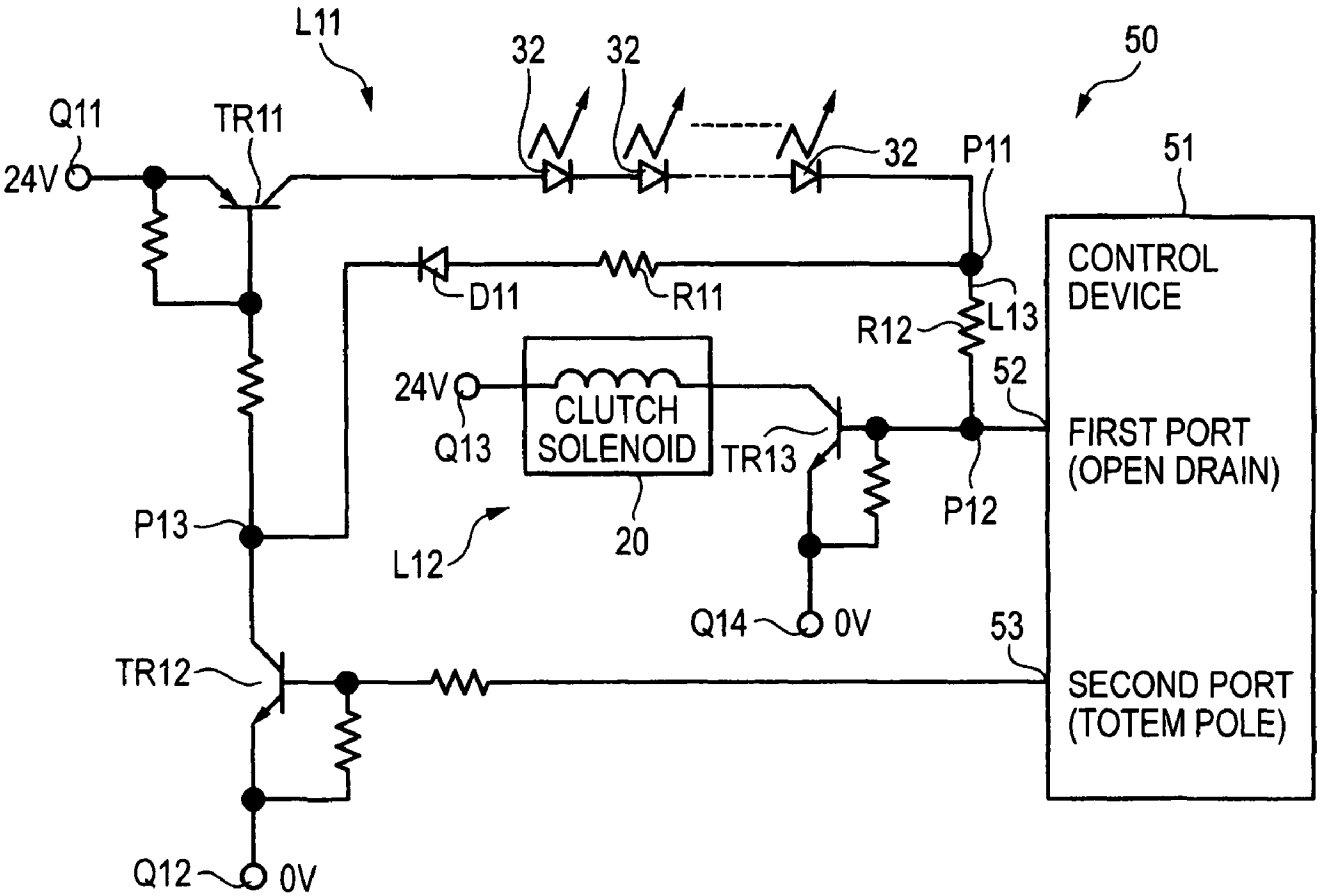
FIG. 3 is a diagram showing a control circuit of electrical component for use in the multi-function apparatus shown in FIG. 1.

FIG. 3 is a diagram showing a control circuit 50 for the electrical components for use in the multi-function apparatus 1 as shown in FIG. 1.

The control circuit 50 controls the turning on/off of the eraser lamps 32 as the first electrical component and the driving of the clutch solenoid 20 as the second electrical component. In the control circuit 50, a transistor TR13 as a drive control unit is connected to a transistor TR11 via the eraser lamps 32 so that the driving of the clutch solenoid 20 is controlled by power supplied from the eraser lamps 32.

The control circuit 50 includes a control device 51 having a CPU, first, second and third transistors TR11, TR12 and TR13, a diode D11 for preventing the reverse current, first and second resistors R11 and R12, the clutch solenoid 20, and the eraser lamps 32 including light emitting diodes. The control circuit 50 has an eraser lamp current supply line L11 for supplying current to the eraser lamps 32 and a clutch solenoid current supply line L12 for supplying current to the clutch solenoid 20, which are connected via a bypass line L13.

The control device 51 includes a first port 52 and a second port 53. The first port 52 is configured as an open drain that can draw the current in a low state and cannot supply the current in a high impedance state. The second port 53 is configured as a totem pole that can supply the current in an on state and can draw the current in an off state.

The eraser lamp current supply line L11 includes the first transistor TR11, the plurality of eraser lamps 32, the first resistor R11, the diode D11, and the second transistor TR12. The eraser lamp current supply line L11 controls the conduction state of the first transistor TR11 and the second transistor TR12 by switching the output of the second port 53 between the high state (hereinafter referred to as "H") and the low state (hereinafter referred to as "L"), and the eraser lamp current supply line L11 controls the turning on/off of the eraser lamps 32.

The first transistor TR11 is a PNP-type transistor. The first transistor TR11 has an emitter connected to a first terminal Q11, a collector connected to the eraser lamps 32, and a base connected via a third connection point P13 to the collector of the second transistor TR12. The first terminal Q11 is connected to a power source as a power supply unit having a voltage as high as 24 volts to supply current to the first transistor TR11.

The eraser lamps 32 are connected on the anode side to the collector of the first transistor TR11, and on the cathode side to the diode D11 via the first resistor R11.

The diode D11 is connected on the anode side to the collector of the first transistor TR11 via the first resistor R11, the first connection point P11, and the eraser lamps 32, and connected on the cathode side to the third connection point P13, The diode D11 prevents a reverse current within the eraser lamp current supply line L11 from flowing.

The second transistor TR12 is an NPN-type transistor. The second transistor TR12 has an emitter connected to a second terminal Q12, a collector connected to the base of the first transistor TR11 via the third connection point P13, and a base connected to the second port 53 of the control device 51. The second terminal Q12 is connected to the ground.

The clutch solenoid current supply line L12 includes the third transistor TR13 as the driving control unit and the clutch solenoid 20 as the second electrical component. The clutch solenoid current supply line L12 controls the driving of the clutch solenoid 20 by controlling the conduction state of the third transistor TR13.

The third transistor TR13 has an emitter connected to a fourth terminal Q14 on the ground side, a collector connected to the third terminal Q13 via the clutch solenoid 20, and a base connected to the first port 52 of the control device 51. The third terminal Q13 is connected to the power source having the voltage of 24 volts to supply current to the clutch solenoid 20.

The bypass line L13 is connected to the first connection point P11 provided on the eraser lamp current supply line L11 and the second connection point P12 provided between the base of the third transistor TR13 on the clutch solenoid current supply line L12 and the first port 52 of the control device 51. The second resistor R12 is disposed in the bypass line L13.

The first resistor R11 and the second resistor R12 are provided to adjust the amount of current of divided from the current flowing through the eraser lamp current supply line L11 into the clutch solenoid current supply line L12. In this aspect, the resistance value of the second resistor R12 is set to be larger than the resistance value of the first resistor R11, so that the amount of current divided into the clutch solenoid current supply line L12 is smaller than the amount of current flowing through the eraser lamp current supply line L11, Accordingly, the clutch solenoid current supply line L12 controls the conduction state of the third transistor TR13 by switching the output of the first port 52 between the high impedance state (hereinafter referred to as "H") and the low impedance state (hereinafter referred to as "L") and controls the operation of the clutch solenoid 20

The operation of the multi-function apparatus 1 having the above configuration will be described below.

In a standby state where the multi-function apparatus 1 does not form the image, the control device 51 sets the output of the second port 53 to "L". In this case, the second transistor TR12 is non-conducting in which no base current flows through the base of the second transistor TR12, and no current flows between the collector and emitter. Therefore, the first transistor TR11 is also non-conducting in which no base current flows and no current flows between the emitter and collector. Hence, the eraser lamps 32 are not supplied with current from the first terminal Q11 via the first transistor TR11 and are turned off.

At this time, since no current is supplied from the side of the eraser lamps 32 to the second connection point P12, base current of the third transistor TR13 does not flow through the control device 51, even if the output of the first port 52 is set to "H". Therefore, the third transistor TR13 is kept non-conducting in which no current flows through the base and no current flows between the collector and emitter while the eraser lamps 32 are turned off, so that the clutch solenoid 20 is de-energized. That is, the third transistor TR13 cannot control the stalling of the clutch solenoid 20. Since the de-energized clutch solenoid 20 disables the power transmission gear train of the sheet feed roller 11 to transmit power, the multi-function apparatus 1 can not pick up the sheet with the sheet feed roller 11.

When the multi-function apparatus 1 forms the image, the control device 51 changes the output of the second port 53 from "L" to "H". The second transistor TR12 conducts in which current is supplied from the second port 53 to the base and current flows between the collector and emitter. Then, the first transistor TR11 also conducts in which current flows between the emitter and base and current flows between the emitter and collector. The current supplied from the first terminal Q11 to the first transistor TR11 flows via the eraser lamps 32, the first connection point P11, the first resistor R11, the diode D11, the third connection point P13, the second transistor TR12, and the second terminal Q12 to the ground. Therefore, the eraser lamps 32 are turned on by the current supplied from the first transistor TR11.

Some of the current supplied to the eraser lamps 32 is divided from the first connection point P11 to the second connection point P12. When the first port 52 of the control device 51 outputs "L", the current supplied to the second connection point P12 flows to the first port 52, and no base current flows through the third transistor TR13. Therefore, the third transistor TR13 becomes non-conducting, so that the clutch solenoid 20 is de-energized. When the clutch solenoid 20 is de-energized, the power transmission gear train of the sheet feed roller 11 is disabled to transmit power, whereby the multi-function apparatus 1 does not pick up the sheet with the sheet feed roller 11.

On the other hand, when the control device 51 outputs "H" to the second port 53, and outputs "H" to the first port 52, current supplied from the eraser lamps 32 flows via the first connection point P11, the second resistor R12 and the second connection point P12 to the third transistor TR13, so that a base current flows through the third transistor TR13. Therefore, the third transistor TR13 conducts, so that the clutch solenoid 20 is energized. When the clutch solenoid 20 is energized, the power transmission gear train of the sheet feed roller 11 is enabled to transmit power, whereby the sheet feed roller 11 of the multi-function apparatus 1 picks up the sheet of the sheet feed cassette 6 and delivers it to the conveying path.

When the sheet feed sensor 21 detects that the sheet feed roller 11 picks up one sheet from the sheet feed cassette 6 and delivers it to the conveying path, the control device 51 outputs "L" from the first port 52 so that the current supplied from the eraser lamps 32 does not flow to the third transistor TR13. Then, the third transistor TR13 becomes non-conducting, so that the clutch solenoid 20 is de-energized again. Thereby, the power transmission gear train of the sheet feed roller 11 is disabled to transmit power, whereby the sheet feed roller 11 of the multi-function apparatus 1 does not pick up the sheet.

Thus, in the multi-function apparatus 1, When the output of the second port 53 is set to "H" to turn on the eraser lamps 32, and the output of the first port 52 is changed from "L" to "H", the stalling of the clutch solenoid 20 can be controlled, and further the pickup operation of the sheet can be controlled by switching the third transistor TR13 between the non-conducting state and the conducting state.

When the multi-function apparatus 1 completes the printing, the control device 51 switches the output of the second port 53 from "H" to "L1". Then, the second transistor TR12 and the first transistor TR11 become non-conducting, so that the eraser lamps 32 are turned off because no current is supplied from the first terminal Q11 via the first transistor TR11.

At the same time, no current is supplied to the second connection point P12, so that the third transistor TR13 is made non-conducting Thereby, even if the first port 52 of the control device 51 outputs "H", the clutch solenoid 20 remains de-energized, so that the power transmission gear train of the sheet feed roller 11 is disabled to transmit power, whereby the sheet feed roller 11 of the multi-function apparatus 1 does not pick up the sheet.

By the way, in the multi-function apparatus 1, the eraser lamps 32 may not light up due to a failure such as a disconnection during the printing. Since the eraser lamps 32 are internally provided within the image forming unit 2 in a condition hidden behind the photosensitive drum 27, the user is difficult to become aware of the failure of the eraser lamps 32. If the printing is continued while the eraser lamps 32 do not light up, the surface of the photosensitive drum 27 may not be uniformly charged, possibly causing a nonconformity such as printing unevenness or printing excess lines in the margin of the sheet.

In this regard, in the multi-function apparatus 1 of this aspect, when the eraser lamps 32 do not light up due to a failure such as a disconnection, the third transistor TR13 is not supplied with current via the second resistor R12 from the eraser lamps 32. In this case, even if the control device 51 outputs "H" from the first port 52, no base current flows through the third transistor TR13, so that the third transistor TR13 is kept non-conducting, whereby the clutch solenoid 20 remains de-energized.

When the multi-function apparatus 1 normally performs the printing, the sheet feed roller 11 is stopped once the sheet feed sensor 21 detects the sheet, and after a certain time passes, the sheet feed roller 11 is rotated again to pick up the sheet. However, if the clutch solenoid 20 is de-energized due to a failure of the eraser lamps 32, the multi-function apparatus 1 cannot rotate the sheet feed roller 11 even when a certain time passes after the sheet feed sensor 21 detects the sheet. Therefore, the multi-function apparatus 1 determines that sheet jam occurs in a part of the sheet feed roller 11, and makes the emergency stop of the printing.

The user confirms whether or not sheet jam occurs near the sheet feed roller 11 of the multi-function apparatus 1, and can notice that failure occurs in the eraser lamps 32, if the emergency stop of printing is made without occurrence of sheet jam.

Accordingly, the multi-function apparatus 1 of this aspect includes the eraser lamps 32, the clutch solenoid 20, and the third transistor TR13 for controlling the driving of the clutch solenoid 20, as well as the first transistor TR11 for supplying power to the eraser lamps 32, in which the third transistor TR13 is connected to the first transistor TR11 via the eraser lamps 32 to control the driving of the clutch solenoid 20 by power supplied from the eraser lamps 32, whereby the failure of the eraser lamps 32 can be informed to the outside if the driving of the clutch solenoid 20 is stopped during the image formation.

In this manner, since the multi-function apparatus 1 shares the existent clutch solenoid 20 as the electrical component for informing the failure of the eraser lamps 32 to the outside, it is unnecessary to provide separately the light emitting element for display to detect the failure, whereby the costs of parts are reduced. Also, with a circuit configuration in which the control circuit 50 simply connects the third transistor TR13 via the eraser lamps 32 to the first transistor TR11 to supply power from the eraser lamps 32 to the third transistor TR13, the failure of the eraser lamps 32 is detected, whereby the circuit configuration of the control circuit 50 is simplified, and the manufacturing cost is lower. Accordingly, the multi-function apparatus 1 of this aspect has a simple electrical circuit structure and can be manufactured cheaply.

Second Aspect

An electrical device and an image forming apparatus according to a second aspect of the present invention will be described below with reference to the drawings.

The electrical device and the image forming apparatus of the second aspect are constituted by the multi-function apparatus 1 as in the first aspect. The multi-function apparatus 1 of the second aspect is different from that of the first aspect in that a display lamp 126 as the "second electrical component" is shared for detecting the failure of the eraser lamps 32 as the "first electrical component", and the display lamp 126 can be controlled for display even when the image is not formed and the eraser lamps 32 are off. Herein, the different point from the first aspect will be mainly described below, and the explanation of common configuration and operation and effect is appropriately omitted. In the explanation and drawings of the second aspect, the same parts as in the first aspect are designated by the same numerals or symbols as used in the first aspect.

Figure 4:
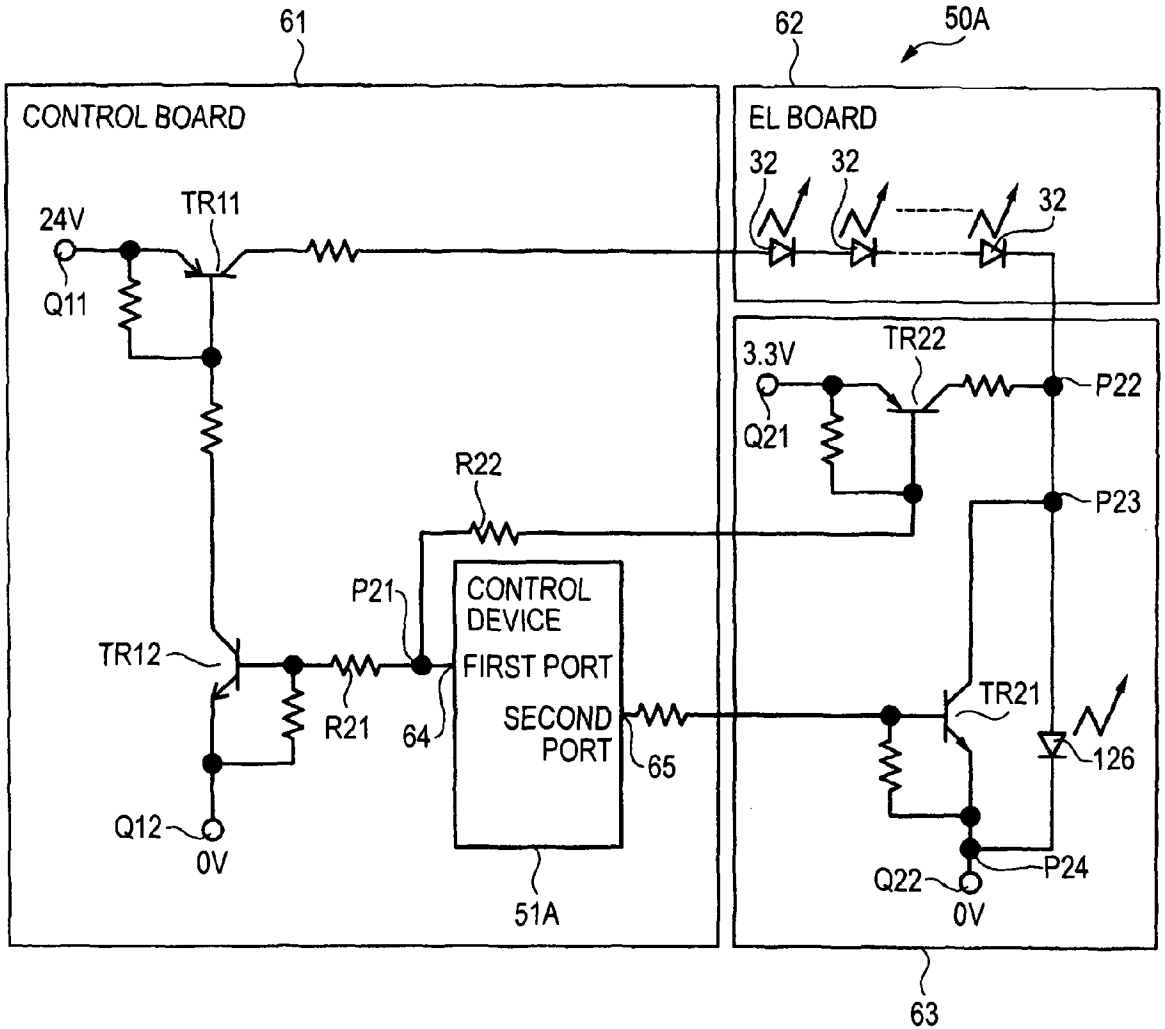
FIG. 4 is a diagram showing a control circuit of electrical component for use in a multi-function apparatus according to another aspect of the present invention.

FIG. 4 is a diagram showing a control circuit 50A of the electrical component for use in the multi-function apparatus 1 according to the second aspect.

The control circuit 50A includes a control board 61, an EL board 62, and a panel board 63. The control device 50A is connected to the first terminal Q11 via the eraser lamps 32 on the EL board 62 and the first transistor TR11 on the control board 61 so that the display lamp 126 on the panel board 63 may be turned on by power supplied from the eraser lamps 32.

The control device 51A is disposed on the control board 61. The control board 61 is provided with the first resistor R21, the second transistor TR12 and the first transistor TR11 to control the current supplied to the eraser lamps 32. Also, the control board 61 is provided with a second resistor R22 on the line branched from between the control device 51A and the second transistor TR12

The control device 51A has a first port 64 and a second port 65, each of which is configured as a totem pole that can supply current to the outside at "H" and draw current at "L".

On the control board 61, the output of the first port 64 for the control device 51A branches at the first connection point P21 into two lines. One branch line is connected via the first resistor R21 to the base of the second transistor TR12. The other branch line is connected via the second resistor R22 to the base of the fifth transistor TR22. The first resistor R21 and the second resistor R22 are provided to adjust the amount of current supplied to the second transistor TR12 and the fifth transistor TR22. In this aspect, the resistance values of the first resistor R21 and the second resistor R22 are set up so that a voltage of 3.3V may be applied to the base of the fifth transistor TR22.

On the EL board 62, a plurality of eraser lamps 32 as the "first electrical component" are connected in series. The anode side of light emitting diodes making up the eraser lamps 32 is connected to the collector of the first transistor TR11, and the cathode side of light emitting diodes making up the eraser lamps 32 is connected via the second connection point P22 and the third connection point P23 to the display lamp 126.

The panel board 63 has the display lamp 126, the fifth transistor TR22 and the fourth transistor TR21.

The display lamp 126 has the anode side of light emitting diode making up the display lamp 126 connected to the third connection point P23 and the cathode side connected to the fourth connection point P24.

The fifth transistor TR22 is a PNP type transistor, and is provided to control the current front a power source connected to the third terminal Q21 to the display lamp 126. The fifth transistor TR22 has the emitter connected to the third terminal Q21, the collector connected-via the resistor to the second connection point P22, and the base connected via the second resistor R22 to the first connection point P21. The third terminal Q21 is connected to the power source having a voltage of 3.3V.

The fourth transistor TR21 is an NPN type transistor, and is provided to control the flashing of the display lamp 126. The fourth transistor T12 has the emitter connected via the fourth connection point P24 to the fourth terminal Q22, the collector connected to the third connection point P23, and the base connected via the resistor to the second port 65 of the control device 51A. The fourth terminal Q22 is connected to the ground.

The operation of the multi-function apparatus 1 having the above configuration according to the second aspect will be described below.

The display lamp 126 of the multi-function apparatus 1 is provided to indicate that the power of the multi-function apparatus 1 is turned on and the multi-function apparatus 1 is operable in the normal state, for example. When the multi-function apparatus 1 is on standby without performing the printing, the control device 51A outputs "L" from the first port 64, so that the first transistor TR11 and the second transistor TR12 become non-conducting. Therefore, no current is supplied from the first terminal Q11 via the first transistor TR11 to the eraser lamps 32, so that the eraser lamps 32 do not light up.

In this case, the display lamp 126 is not supplied with current from the side of the eraser lamps 32. However, at this time, since the control device 51A outputs "L" from the first port 64, a base current of the fifth transistor TR22 flows, so that the fifth transistor TR22 conducts because current flows between emitter and collector. Then, current supplied from the third terminal Q21 to the fifth transistor TR22 flows via the second connection point P22 to the third connection point P23.

In this state, when the control device 51A outputs "L" from the second port 65, no base current of the fourth transistor TR21 flows, so that the fourth transistor TR21 becomes non-conducting in which no current flows between collector and emitter. Therefore, current supplied to the third connection point P23 flows to the display lamp 126 and turns on the display lamp 126.

On the contrary, when the control device 51A outputs "H" from the second port 65, a base current of the fourth transistor TR21 flows, so that the fourth transistor TR21 conducts in which current flows between collector and emitter. Therefore, current supplied to the third connection point P23 flows via the fourth transistor TR21 and the fourth terminal Q22 to the ground. In this case, no current flows to the side of the display lamp 126, so that the display lamp 126 is turned off.

Accordingly, when the multi-function apparatus 1 is operable in the normal state even on standby where the power is turned on but the printing is not performed, the multi-function apparatus 1 can inform the user of a printable state by outputting "L" from the second port 65 to turn on the display lamp 126. On the contrary, when the multi-function apparatus 1 is inoperable in the abnormal state, the multi-function apparatus 1 can inform the user of an unprintable state by outputting "H" from the second port 65 to turn off the display lamp 126.

Thereafter, when the multi-function apparatus 1 performs the printing, the multi-function apparatus 1 changes the first port 64 of the control device 51A from "L" to "H". In this case, the first transistor TR11 and the second transistor TR12 conduct, so that the eraser lamps 32 light up.

A current supplied from the first terminal Q11 via the first transistor TR11 to the eraser lamps 32 is supplied via the second connection point P22 to the third connection point P23. The power source is connected via the fifth transistor TR22 to the second connection point P22. However, a voltage outputted from the first port 64 of the control device 51A is supplied to the base of the fifth transistor TR22, whereby a voltage of 3.3V is applied to the base. Therefore, since the fifth transistor TR22 is out of conduction in which no current flows between emitter and base, current supplied from the side of the eraser lamps 32 only flows to the second connection point P22.

A current flowing from the second connection point P22 to the third connection point P23 flows via the display lamp 126 or the fourth transistor TR21 to the ground, depending on whether the second port 65 of the control device 51A is at "H" or "L". That is, when the control device 51A outputs "L" from the second port 65, no base current flows through the fourth transistor TR21, so that the fourth transistor TR21 becomes non-conducting, whereby current supplied to the eraser lamps 32 flows from the third connection point P23 to the display lamp 126 to turn on the display lamp 126. On the contrary, when the control device 51A outputs "H" from the second port 65, a base current flows through the fourth transistor TR21, so that the fourth transistor TR21 conducts, whereby current supplied to the eraser lamps 32 flows from the third connection point P23 via the fourth transistor TR21 and the fourth terminal Q22 to the ground to turn off the display lamp 126.

Accordingly, the multi-function apparatus 1 controls the display lamp 126 to be turned on or off by switching the output of the second port 65 provided in the control device 51A between "H" and "L", and informs the user of whether or not the multi-function apparatus 1 is operable in the normal state.

Herein, in the multi-function apparatus 1, when a failure occurs in the eraser lamps 32, the eraser lamps 32 do not light up, even if the control device 51A sets the first port 64 to "H" during the printing. In this case, current supplied from the first transistor TR11 to the eraser lamps 32 does not flow to the display lamps 126 due to a breakdown of the eraser lamps 32.

And a voltage supplied from the first port 64 of the control device 51A is supplied to the base of the fifth transistor TR22, and a voltage of 3.3V is applied to the base, so that the fifth transistor TR22 becomes non-conducting in which no current is supplied to the second connection point P22. Hence, the display lamp 126 is not supplied with current from the fifth transistor TR22.

In this case, the multi-function apparatus 1 performs the normal image forming operation in the state where the display lamp 126 is turned off. Therefore, the user can notice that the display lamp 126 is turned off during the image formation, namely, a false indication of the display lamp 126, and a failure such as a disconnection occurs in the eraser lamps 32.

Accordingly, the multi-function apparatus 1 of this aspect includes the eraser lamps 32 and the display lamp 126, as well as the first transistor TR11 for supplying power to the eraser lamps 32, in which the display lamp 126 provided on the operation part 121 of the image reading unit 100 is connected via the eraser lamps 32 to the first transistor TR11 to light up by power supplied from the eraser lamps 32, and a failure of the eraser lamps 32 can be informed to the outside, because the display lamp 126 does not normally light up during the image formation.

In this manner, since the multi-function apparatus 1 shares the existent display lamp 126 as the electrical component for informing the failure of the eraser lamps 32 to the outside, it is unnecessary to provide the light emitting element for display to detect the failure, whereby the costs of parts are reduced. Also, with a circuit configuration in which the control circuit 50A simply connects the display lamp 126 via the eraser lamps 32 to the first transistor TR11 to supply power from the eraser lamps 32 to the display lamp 126, the failure of the eraser lamps 32 is detected, whereby the circuit configuration of the control circuit 50A is simplified, and the manufacturing cost is lower. Hence, the multi-function apparatus 1 of this aspect has a simple electrical circuit structure and can be manufactured cheaply.

Third Aspect

An electrical device and an image forming apparatus according to a third aspect of the present invention will be described below with reference to the drawings.

The electrical device and the image forming apparatus of the third aspect are constituted by the multi-function apparatus 1 as in the first aspect. The multi-function apparatus 1 of the third aspect is different from that of the first aspect in that a register sensor 13 as the "second electrical components" and the "emission sensor" is shared for detecting the failure of the eraser lamps 32 as the "first electrical component". Herein, the different point from the first aspect will be mainly described below, and the explanation of common configuration and operation and effect is appropriately omitted. In the explanation and drawings of the third aspect, the same parts as in the first aspect are designated by the same numerals or symbols as used in the first aspect.

Figure 5:
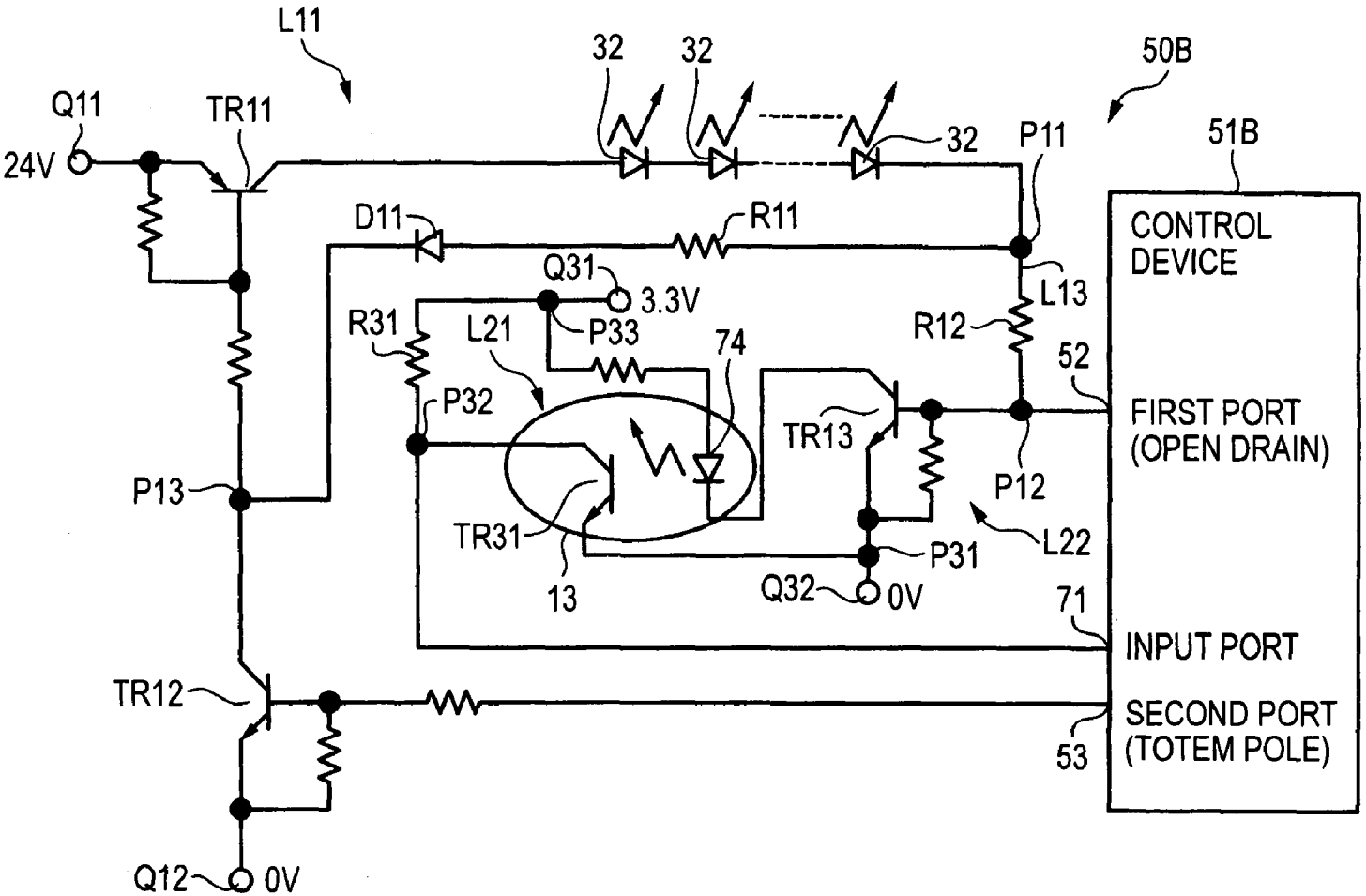
FIG. 5 is a diagram showing a control circuit of electrical component for use in a multi-function apparatus according to still another aspect of the present invention.

FIG. 5 is a diagram showing a control circuit 50B of the electrical component for use in the multi-function apparatus 1 according to the third aspect.

The control circuit 50B includes the control device 51B, an eraser lamp current supply line L11 for supplying current to the eraser lamps 32, a light emitting part current supply line L22 for supplying current to a light emitting part 74 as the "light emitting unit", a bypass line L13 for connecting the eraser lamp current supply line L11 and the light emitting part current supply line L22, and a detection line L21 for inputting a detection signal. The control circuit 50B connects the light emitting part 74 via the third transistor TR13, the second resistor R12, the eraser lamps 32 and the first transistor T11 to the first terminal Q11 so that the light emitting part 74 of the register sensor 13 may emit the light by power supplied from the eraser lamps 32.

The control device 51B includes the first port 52, the second port 53 and an input port 71. The input port 71 is connected to the fifth connection point P32 and supplied with a detection voltage.

The light emitting part current supply line L22 includes the third transistor TR13, and the light emitting part 74 having a light emitting diode. The light emitting part 74 has the anode side of the light emitting diode connected via the resistor and the sixth connection point P33 to the fifth transistor Q31, and on the other hand, has the cathode side connected to the collector of the third transistor TR13. The fifth terminal Q31 is connected to the power source having a voltage of 3.3V.

The detection line L21 is provided with the register sensor 13 having the light emitting part 74 and the sixth transistor TR31 having a light receiving element serving as the light receiving part. In the register sensor 13, the light emitting part 74 and the sixth transistor TR31 are opposed across a shaking member shakably held on the sheet conveying path, and a light shielding member attached on the shaking member shields the optical path of a detection light directed from the light emitting part 74 to the sixth transistor TR31. The shaking member is kept in a standing state due to a biasing force of a biasing member such as a spring, and juts out on the conveying path.

The sixth transistor TR31 is an NPN type transistor. The sixth transistor TR31 has the emitter connected via the fourth connection point P31 to the sixth terminal Q32. Also, the sixth transistor TR31 has the collector connected via the fifth connection point P32, the resistor R31 and the sixth connection point P33 to the fifth terminal Q31, and connected via the fifth connection point P32 to the input port 71 of the control device 51B. Further, the sixth transistor TR31 has the base opposed to the light emitting part 74. Current flows through the base of the sixth transistor TR31 when light is received. The sixth terminal Q32 is connected to the ground.

The operation of the multi-function apparatus 1 having the above configuration according to the third aspect will be described below.

When the multi-function apparatus 1 is on standby where the printing is not performed, the control device 51B outputs "L" from the second port 53, so that the first transistor TR11 and the second transistor TR12 become non-conducting to turn off the eraser lamps 32. At this time, even if the control device 51B sets the first port 52 to "H", the third transistor TR13 does not conduct, so that the light emitting part 74 does not emit the light.

On the contrary, when the multi-function apparatus 1 performs the printing, the control device SIB changes the output of the second port 53 from "L" to "H", so that the first transistor TR11 and the second transistor TR12 conduct to turn on the eraser lamps 32. The control device 51B changes the output of the first port 52 from "L" to "H" after starting the printing, so that part of the current supplied to the eraser lamps 32 is supplied via the second resistor R12 to the third transistor TR13 to cause the third transistor TR13 to conduct. Thereby, the light emitting part 74 of the register sensor 13 emits the light.

Though the light emitting part 74 of the register sensor 13 emits the light, when the sheet does not pass by the register sensor 13 during the printing in the multi-function apparatus 1, a detection light of the light emitting part 74 is shielded by the light shielding member disposed between the light emitting part 74 and the sixth transistor TR31. Therefore, the sixth transistor TR31 does not receive the detection light from the light emitting part 74, and is kept non-conducting. As a result, the voltage of the fifth connection point P32 is almost equal to the voltage of the fifth terminal Q31, or 3.3 volts, so that this voltage is applied to the input port 71. Thereby, the control device 51B determines that the register sensor 13 does not detect the sheet because the input port 71 is at high state (hereinafter referred to as "H").

Thereafter, if the multi-function apparatus 1 picks up the sheet from the sheet feed cassette 6 and conveys it, the sheet is pushed against the shaking member jutting out on the conveying path to shake the shaking member. Then, the light shielding member attached to the shaking member is displaced from the optical path of the detection light, so that the detection light directed from the light emitting part 74 arrives at the base of the sixth transistor TR31. Thereby, the sixth transistor TR31 conducts, so that the voltage of the fifth connection point P32 drops, and a dropped voltage is supplied to the input port 71. Thereby, the control device 51B determines that the register sensor 13 detects the sheet, because the input port 71 is at low state (hereinafter referred to as "L").

Thereafter, if the sheet passes by the register sensor 13, the shaking member automatically returns to the standing state due to a biasing force of the biasing member, so that the light shielding member shields the optical path of the detection light. Therefore, the sixth transistor TR31 is kept non-conducting. Thereby, the control device 51B determines that the register sensor 13 does not detect the sheet because the input port 71 is set to "H".

Accordingly, the multi-function apparatus 1 can control the light emitting condition of the light emitting part 74, if the third transistor TR13 is switched between the non-conducting state and the conductive state by switching the output of the first port 52 for the control device 51B between "L" and "H" during the printing. And when the light emitting part 74 emits the light, the control device 51B can detect whether the sixth transistor TR31 conducts or not depending on "L"/"H" of the input port 71, and determine whether or not the sheet is conveyed up to the register roller 12.

Herein, when a failure such as a disconnection occurs in the eraser lamps 32, current supplied to the eraser lamps 32 is not supplied via the second resistor R12 to the third transistor TR13, even if the first port 52 of the control device 51B is set to "H", whereby the third transistor TR13 is kept non-conducting, so that the light emitting part 74 of the register sensor 13 does not emit the light.

The multi-function apparatus 1 measures the time since the sheet feed sensor 21 detects the sheet until the register sensor 13 detects the sheet, and confirms whether or not the sheet is conveyed at a proper conveying interval. If the light emitting part 74 does not emit the light due to a failure in the eraser lamps 32, the register sensor 13 does not detect the sheet, after the sheet feed sensor 21 detects the sheet, whereby the multi-function apparatus 1 determines that a conveying failure occurs because the sheet is not conveyed at the proper conveying interval, and makes the emergency stop of the printing. The user confirms a factor of conveying failure, and notices that the eraser lamps 32 fail because of emergency stop of the printing although there is no factor of conveying failure.

Accordingly, the multi-function apparatus 1 of this aspect includes the eraser lamps 32 and the light emitting part 74 of the register sensor 13, as well as the first transistor TR11 for supplying power to the eraser lamps 32, in which the light emitting part 74 is connected via the eraser lamps 32 to the first transistor TR11 so that the light emitting part 74 of the register sensor 13 may light up by power supplied from the eraser lamps 32, whereby a failure of the eraser lamps 32 can be informed to the outside because of emergency stop of the printing when the register sensor 13 can not normally perform the sensing.

In this manner, since the multi-function apparatus 1 of this aspect shares the existent light emitting part 74 as the electrical component for informing the failure of the eraser lamps 32 to the outside, it is unnecessary to provide separately the light emitting element for display to detect the failure, whereby the costs of parts are reduced. Also, with a circuit configuration in which the control circuit 50B simply connects the light emitting part 74 via the eraser lamps 32 to the first transistor TR11 to supply power from the eraser lamps 32 to the light emitting part 74, the failure of the eraser lamps 32 is detected, whereby the circuit configuration of the control circuit 50B is simplified, and the manufacturing cost is lower. Hence, the multi-function apparatus 1 of this aspect has a simple electrical circuit structure and can be manufactured cheaply.

Fourth Aspect

An electrical device and an image forming apparatus according to a second aspect of the present invention will be described below with reference to the drawings.

The electrical device and the image forming apparatus of the fourth aspect are constituted by the multi-function apparatus 1 as in the first aspect. The multi-function apparatus 1 of the fourth aspect is different from that of the third aspect in that the register sensor 13 as the "second electrical component" and the "emission sensor" is shared for detecting the failure of the eraser lamps 32 as the "first electrical component" and the light emitting part 74 of the register sensor 13 can emit the light while the eraser lamps 32 are turned off. Herein, the different point from the third aspect will be mainly described below, and the explanation of common configuration and operation and effect is appropriately omitted. In the explanation and drawings of the fourth aspect, the same parts as in the second aspect are designated by the same numerals or symbols as used in the third aspect.

Figure 6:
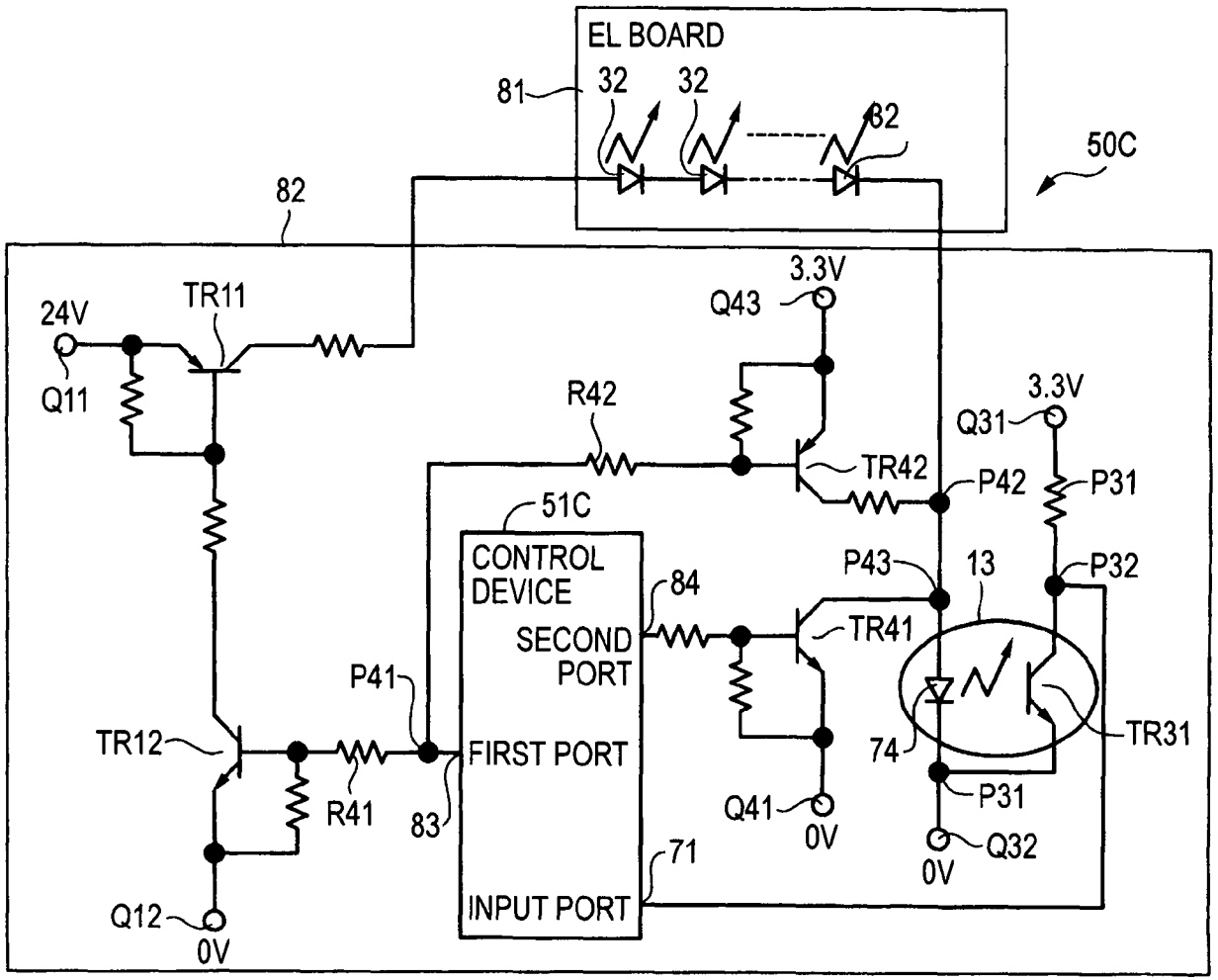
FIG. 6 is a diagram showing a control circuit of electrical component for use in a multi-function apparatus according to still another aspect of the present invention.

FIG. 6 is a diagram showing a control circuit 50C of the electrical component for use in the multi-function apparatus 1 according to the fourth aspect.

The control circuit 50C includes a control board 82 on which the control device 51C is mounted, and an EL board 81 on which the eraser lamps 32 are mounted. The control circuit 50C, by the control device 51C, controls the turning on/off of the eraser lamps 32 and the light emitting state of the light emitting part 74 of the register sensor 13.

The control device 51C of the control board 82 includes a first port 83, a second port 84 and the input port 71. The first port 83 and the second port 84 are configured as a totem pole that can draw the current at low state (hereinafter referred to as "L" state), and supply the current at high state (hereinafter referred to as "H" state). The input port 71 detects the voltage of the fifth connection point P32 to detect the sheet.

The control board 82 is provided with the register sensor 13. The light emitting part 74 of the register sensor 13 has the anode side of the light emitting diode making up the light emitting part 74 connected via the ninth connection point P43, the eight connection point P42, the eraser lamps 32, and the first transistor TR11 to the first terminal Q11, and has the cathode side connected via the fourth connection point P31 to the sixth terminal Q32. The sixth transistor TR31 as the light receiving element for receiving the detection light of the light emitting part 74 has the emitter connected via the fourth connection point P31 to the sixth terminal Q32, and the collector connected via the fifth connection point P32 and the resistor R31 to the fifth terminal Q31.

Also, the control board 82 is provided with the eighth transistor TR42 for supplying power to the light emitting part 74 on another route to the eraser lamps 32. The eighth transistor TR42 has the emitter connected to the ninth terminal Q43, the collector connected via the resistor, the eighth connection point P42 and the ninth connection point P43 to the light emitting part 74, and the base connected via the fifth resistor R42 and the seventh connection point P41 to the first port 83 of the control device 51C.

Herein, the fourth resistor R41 and the fifth resistor R42 are connected in parallel to the seventh connection point P41 to determine the current values flowing to the second transistor TR12 and the eighth transistor TR42. The resistance values of the fourth resistor R41 and the fifth resistor R42 are set up so that when the first port 64 is at "H", the base current of the second transistor TR12 has an appropriate value, and when the first port 64 is at "L", the base current of the eighth transistor TR42 has an appropriate value.

The control board 82 is provided with the seventh transistor TR41 to control the on/off of the light emitting part 74 of the register sensor 13. The seventh transistor TR41 has the emitter connected to the seventh terminal Q41, the collector connected to the ninth connection point P43, and the base connected via the resistor to the second port 84 of the control device 51C. The seventh terminal Q41 is connected to 0 volt.

The operation of the multi-function apparatus 1 having the above configuration according to the fourth aspect will be described below.

When the multi-function apparatus 1 is on standby where the printing is not performed, the control device 51C sets the output of the first port 83 to "L", so that the first transistor TR11 and the second transistor TR12 become non-conducting to turn off the eraser lamps 32.

At this time, the eighth transistor TR42 supplies a current supplied from the ninth terminal Q43 to the eighth connection point P42, because a base current flows. The current flows from the eighth connection point P42 to the ninth connection point P43. When the control device 51C sets the second port 84 to "L", the seventh transistor TR41 becomes non-conducting, because no base current of the seventh transistor TR41 flows. Therefore, a current supplied to the ninth connection point P43 is supplied to the light emitting part 74 to cause the light emitting part 74 to emit the light. On the contrary, when the control device 51C sets the second port 84 to "H", the seventh transistor TR41 conducts, because a base current of the seventh transistor TR41 flows. Therefore, current supplied to the ninth connection point P43 flows via the seventh transistor TR41 to the seventh terminal Q41 not to cause the light emitting part 74 to emit the light.

Hence, the multi-function apparatus 1 can control the light emitting state of the light emitting part 74 by switching the second port 84 between "L" and "H", even on standby.

On the other hand, when the multi-function apparatus 1 performs the printing, the control device 51C changes the first port 83 from "L" to "H", so that the first transistor TR11 and the second transistor TR12 conduct to turn on the eraser lamps 32. The control device 51C sets the output of the second port 84 to "L" to detect the sheet with the register sensor 13 during the printing. Therefore, current supplied to the eraser lamps 32 flows via the eighth connection point P42 and the ninth connection point P43 to the light emitting part 74 to cause the light emitting part to emit the light.

When the detection light of the light emitting part 74 is shielded by the light shielding member disposed between the light emitting part 74 and the sixth transistor TR31, no base current of the sixth transistor TR31 flows, so that the voltage of the fifth connection point P32 is almost equal to the voltage of the fifth terminal Q31, or 3.3 volts. Then, the control device 51C determines that a voltage of "H" is applied from the fifth connection point P32 to the input port 71, and the register sensor 13 does not detect the sheet. However, when the light shielding member is displaced from the optical path of the detection light, and the detection light of the light emitting part 74 arrives at the base of the sixth transistor TR31 to cause the sixth transistor TR31 to conduct, the voltage of the fifth connection point P32 is lowered. Then, the control device 51C determines that a voltage of "L" is applied from the fifth connection point P32 to the input port 71, and the register sensor 13 detects the sheet.

Accordingly, the multi-function apparatus 1 allows the light emitting part 74 to emit the light by current supplied to the eraser lamps 32 and the register sensor 13 to make the sensing.

Herein, in the multi-function apparatus 1, if a failure occurs in the eraser lamps 32 during the printing, current supplied from the first terminal Q11 via the first transistor TR11 to the eraser lamps 32 does not flow to the light emitting part 74. Also, in the multi-function apparatus 1, since the control device 51C sets the output of the first port 83 to "H" to bring the eighth transistor TR42 out of conduction during the printing, current is not supplied from the eighth transistor TR42 to the light emitting part 74. Accordingly, the register sensor 13 can not make the sensing because the light emitting part 74 does not emit the light during the printing.

The multi-function apparatus 1 determines whether or not any conveying failure occurs based on the sheet detection results of the sheet feed sensor 21 and the register sensor 13. Therefore, if the register sensor 13 can not make the sensing due to a failure of the eraser lamps 32, the multi-function apparatus 1 determines that a conveying failure occurs and makes the emergency stop of the printing. The user confirms the factor of conveying failure, and notices that the eraser lamps 32 fail because of the emergency stop of the printing if there is no factor of the conveying failure.

Accordingly, since the multi-function apparatus 1 of this aspect shares the light emitting part 74 of the register sensor 13 for detecting the failure in the eraser lamps 32, it is unnecessary to provide separately the electrical component for display to detect the failure in the eraser lamps, whereby the number of parts is reduced. Also, the light emitting part 74 is only connected via the eraser lamps 32 to the collector of the first transistor TR11 to detect the failure of the eraser lamps 32, whereby the circuit configuration of the control circuit 50C is simplified, and the manufacturing cost is lower. Hence, the multi-function apparatus 1 of this aspect has a simple electrical circuit structure and can be manufactured cheaply.

Also, the multi-function apparatus 1 of this aspect can control the conduction of the seventh transistor TR71 by switching the second port 84 of the control device 51C between "L" and "H", and control the light emitting state of the light emitting part 74 of the register sensor 13, whereby the light emitting part 74 can emit the light, only when needed, to assure the life of the light emitting part 74.

While the aspects of the present invention have been described above, the present invention is not limited to the above aspects, but various applications may be made.

For example, the multi-function apparatus 1 is employed as the electronic device or image forming apparatus in the above aspects, but a printer apparatus, a facsimile apparatus or a copying apparatus may be employed as the electronic device or image forming apparatus. Also, an inkjet printer may be employed, besides the laser printer as in the above aspects.

For example, the eraser lamps 32 are employed as the first electrical component in the above aspects, but the electrical component such as an LED array or a light emitting element in which it is difficult to detect the failure may be employed as the first electrical component.

For example, the clutch solenoid 20 for controlling the stalling of the sheet feed roller 11 is employed as the drive control unit in the above first aspect, but the clutch solenoid 20 for controlling the stalling such as the register roller 12 may be employed as the drive control unit.

While in the above third and fourth aspects, the register sensor 13 is employed as the optical sensor, a sensor for sensing the set state of the sheet feed cassette 6 may be employed as the optical sensor. The user can easily confirm the set state of the sheet feed cassette 6 from outside the multi-function apparatus 1 and simply notice the failure of the eraser lamps 32.

What is claimed is:

1. An image forming apparatus comprising:

a photo-conductor;

an eraser lamp that eliminates electric charge from the photo-conductor;

a display device that is disposed on a main body of the image forming apparatus, the display device configured to execute a display operation;

a drive control unit that controls the display device; and a power supply unit that supplies power to the eraser lamp, wherein the drive control unit is connected with the eraser lamp, the drive control unit controlling the display device to operate by power supplied from the eraser lamp when the eraser lamp is normally operated.

2. An image forming apparatus comprising:

a photo-conductor;

an eraser lamp that eliminates electric charge from the photo-conductor;

a sheet conveying mechanism that conveys a sheet along a conveying path;

a drive control unit that controls the sheet conveying mechanism; and a power supply unit that supplies power to the eraser lamp, wherein the device control unit is connected with the eraser lamp, the drive control unit controlling the sheet conveying mechanism to operate by power supplied from the eraser lamp when the eraser lamp is normally operated.

3. The image forming apparatus according to claim 2, wherein:

the sheet conveying mechanism has an optical sensor that detects whether or not the sheet is conveyed to a predetermined position of the conveying path, and the drive control unit controls the optical sensor by power supplied from the eraser lamp when the eraser lamp is normally operated.

* * * * *